US007246710B2

(12) United States Patent
Graneto, III

(10) Patent No.: US 7,246,710 B2
(45) Date of Patent: Jul. 24, 2007

(54) EXPANDABLE SHELVING APPARATUS AND METHOD OF USE

(75) Inventor: Joseph A. Graneto, III, Wildwood, MO (US)

(73) Assignee: Salus Corporation, St. Louis, MO (US)

( * ) Notice: Subject to any disclaimer, the term of this patent is extended or adjusted under 35 U.S.C. 154(b) by 0 days.

(21) Appl. No.: 10/973,627

(22) Filed: Oct. 26, 2004

(65) Prior Publication Data

US 2005/0087507 A1 Apr. 28, 2005

Related U.S. Application Data

(60) Provisional application No. 60/514,511, filed on Oct. 27, 2003.

(51) Int. Cl.
*A47F 5/08* (2006.01)

(52) U.S. Cl. ..... 211/90.01

(58) Field of Classification Search ..... 211/90.01, 211/87.01, 88.01, 89.01, 90.02, 71.01, 85.17, 211/189

See application file for complete search history.

(56) References Cited

U.S. PATENT DOCUMENTS 887,272 A * 5/1908 Robinson ..... 248/68.1
2,538,958 A * 1/1951 Augenfeld ..... 108/108
5,107,636 A 4/1992 Schindele et al.
5,333,744 A * 8/1994 LoCicero et al. ..... 211/87.01
5,762,213 A 6/1998 Heneveld, Sr.
5,884,784 A * 3/1999 Betts, Sr. ..... 211/88.01
6,332,548 B1 12/2001 West et al.
6,378,709 B1 4/2002 Stuart
6,460,710 B1 10/2002 Dardashti
6,490,983 B1 12/2002 Nicholson et al.
6,591,995 B1 * 7/2003 Grove ..... 211/87.01
6,688,240 B2 2/2004 Ondrasik
6,814,245 B2 11/2004 Leclerc et al.

* cited by examiner

*Primary Examiner*—Sarah Purol
(74) *Attorney, Agent, or Firm*—Armstrong Teasdale LLP

(57) ABSTRACT

A shelving apparatus is disclosed which includes a mounting frame configured for attachment to a surface and a plurality of holding shelves. The mounting frame includes a plurality of mounting holes formed therethrough and the plurality of holding shelves are configured to engage the mounting holes. The holding shelves area separately mountable to the mounting frame vertically opposed to one another such that an item inserted between the holding shelves is engaged by the holding shelves.

25 Claims, 11 Drawing Sheets

EXPANDABLE SHELVING APPARATUS AND METHOD OF USE

CROSS REFERENCE TO RELATED APPLICATIONS

This application claims the benefit of U.S. Provisional Application No. 60/514,511, filed Oct. 27, 2003, which is hereby incorporated by reference in its entirety.

BACKGROUND OF THE INVENTION

This invention relates generally to shelving devices, and more specifically to a shelving apparatus which is especially useful in the medical office and hospital environment.

Today's medical office and hospital environment includes an extraordinary amount of personal protection equipment including, but not limited to, examination gloves, face masks, protection gowns, and hand wash along with the traditional medical supplies including bandages of varying sizes and topically applied treatments, for example, alcohol wipes, ointments, and other cleansing solutions. Traditionally, at least some of these products are prepackaged, for example, with 100 bandages in a box or 50 alcohol wipes in a dispenser. These prepackaged products have been stored for usage in a cabinet or on a counter. However, with the ever increasing amount of such medical supplies, cabinet and counter space is at a premium. In addition, due to ever increasing time constraints being placed on medical practitioners, convenience and ease of access is becoming more important.

BRIEF DESCRIPTION OF THE INVENTION

In one aspect, a shelving apparatus is provided that comprises a mounting frame configured for attachment to a surface. The mounting frame comprises a plurality of mounting holes formed therethrough. The shelving apparatus further comprises a plurality of holding shelves each configured to engage the mounting holes. The holding shelves are separately mountable to the mounting frame in an orientation vertically opposed to one another such that an item inserted between the holding shelves is engaged by the holding shelves.

In another aspect, an apparatus for retaining an item is provided. The apparatus comprises two holding shelves that are configured for attachment to a mounting frame. The holding shelves are separately attachable to the mounting frame in an orientation vertically opposed to one another such that an item inserted between the holding shelves is engaged by the holding shelves.

In still another aspect, an expandable shelf system configured to be attached to a mounting frame is provided. The expandable shelf system comprises an inner tray portion and an outer tray portion. The inner tray portion comprises a body portion and an end portion extending substantially perpendicularly from an end of the body portion. The outer tray portion is configured to engage the inner tray portion. The outer tray portion comprises a body portion having an underside and an end portion extending in an "L" shape from an end of the body portion.

DETAILED DESCRIPTION OF THE INVENTION

Figure 1:
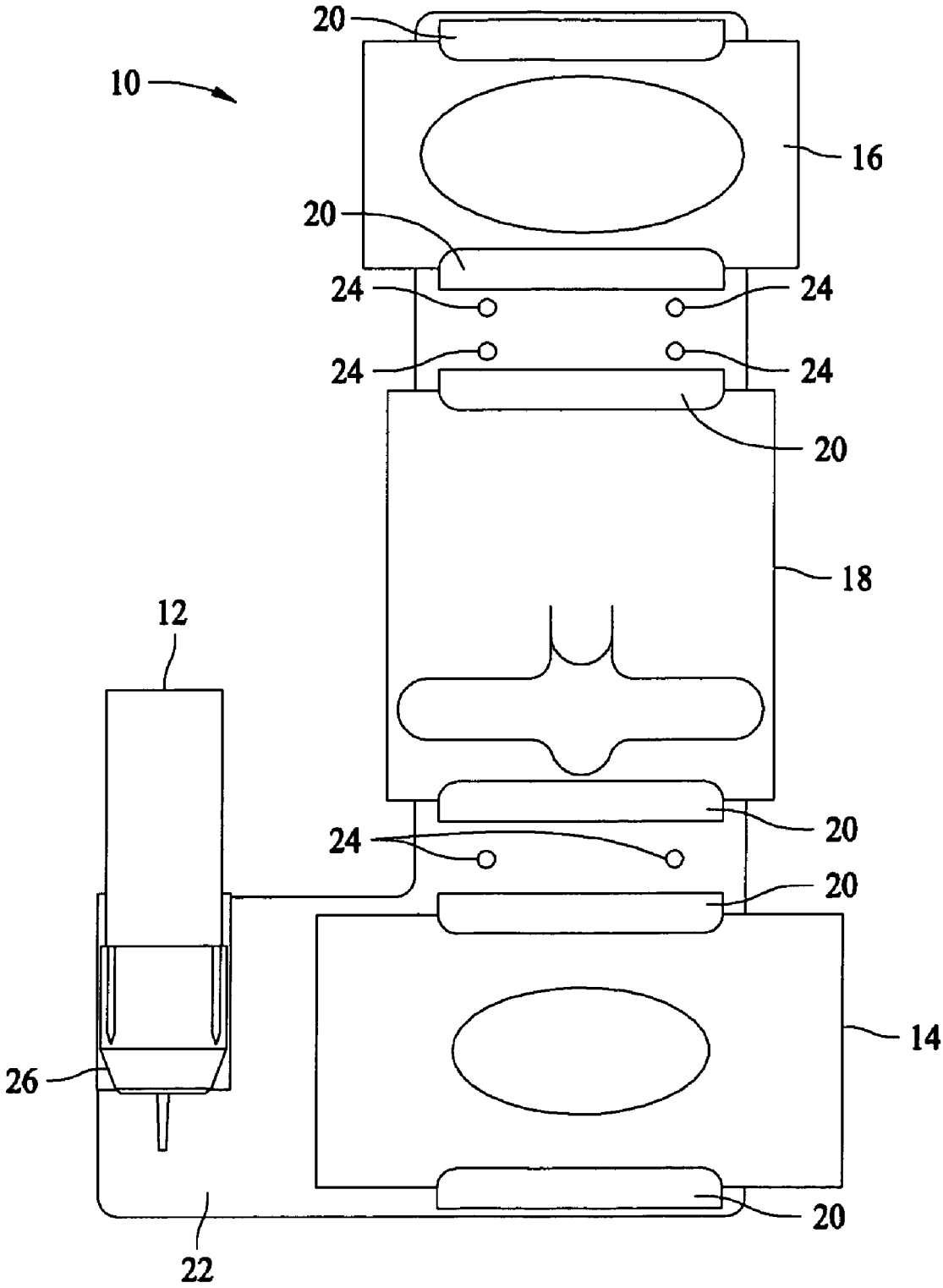
FIG. 1 is a front view of an expandable shelving apparatus showing a hand wash dispenser and glove, gown, and face mask box dispensers inserted therein.

FIG. 1 is a front view of an expandable shelving apparatus 10 showing a hand wash dispenser 12, a surgical glove dispenser 14, a medical gown dispenser 16, and a face mask box dispenser 18 attached thereto. Such dispensers are sometimes referred to collectively herein as personal protection equipment (PPE) dispensers. As illustrated, the personal protection equipment dispensers are attached to shelving apparatus 10 by being inserted between individual holding shelves 20 that are attached to a mounting frame 22.

Mounting frame 22 includes a plurality of mounting holes 24, which in one embodiment, are spaced about 2.5 inches apart, into which holding shelves 20 and/or other mounting devices may be inserted. Alternative embodiments utilize a spacing for mounting hole 24 other than 2.5 inches or utilize single mounting holes 24. Mounting frame 22 may take many forms or shapes such as rectangular, circular, or elliptical forms or combinations of various sizes of the aforesaid forms. A canister insertion shelf 26 is attached to mounting frame 22 and is configured to hold, for example, an aerosol container of hand washing solution (e.g., hand wash dispenser 12).

Figure 2:
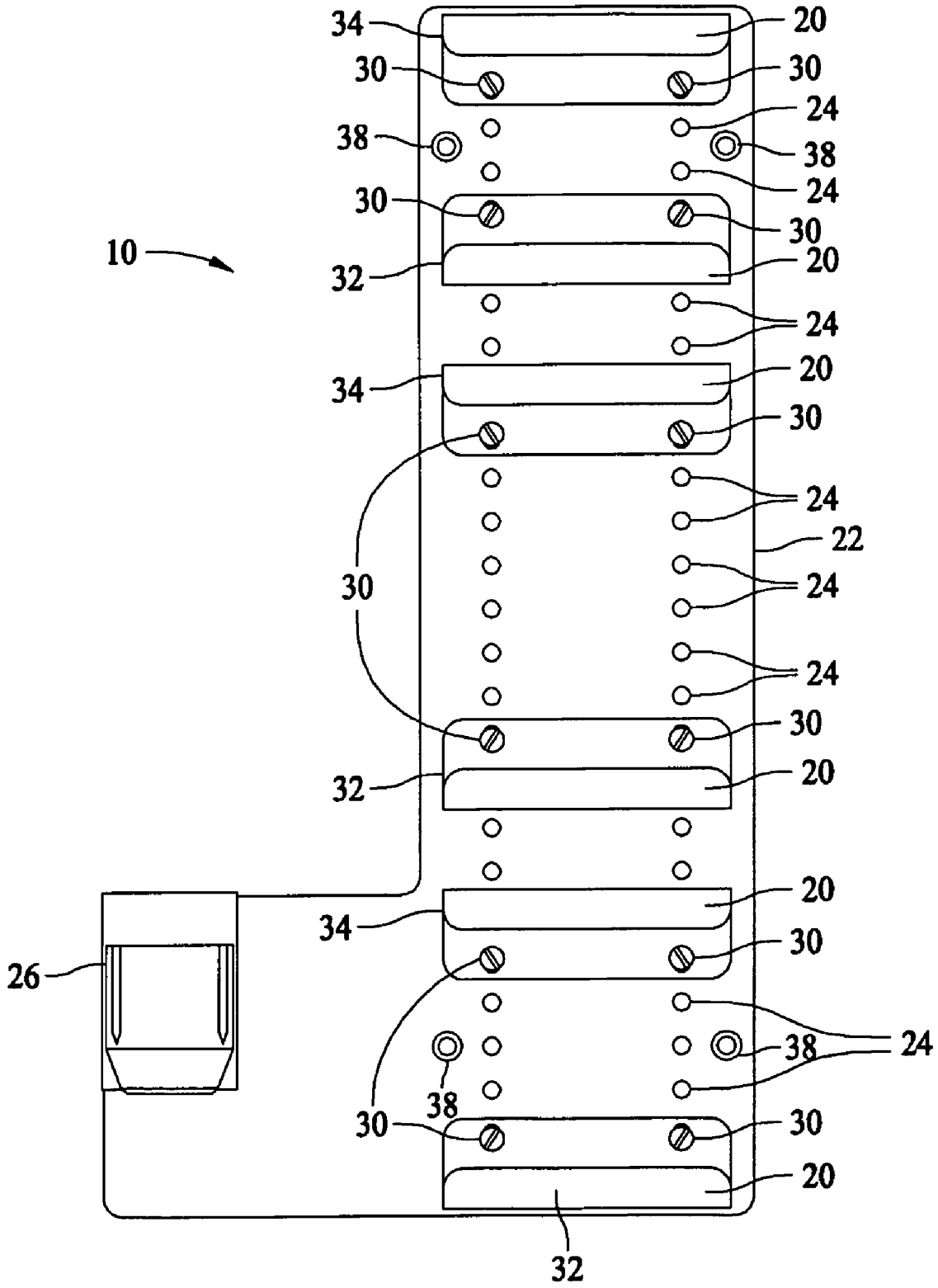
FIG. 2 is a front view of the expandable shelving apparatus of FIG. 1 without the hand wash dispenser and glove, gown, and face mask box dispensers inserted therein.

FIG. 2 is a front view of expandable shelving apparatus 10 without the PPE dispensers inserted. In one embodiment, and as further described below, holding shelves 20 have a substantially "U" shaped cross section, the "U" referring to members substantially forming three sides of a rectangle or square. Further, holding shelves 20 are configured with openings 30 which are spaced to match the spacing of mounting holes 24, enabling mounting of holding shelves 20 to mounting frame 22. Screws, bolts, or other fasteners are inserted through openings 30 and mounting holes 24 to fasten holding shelves 20 to mounting frame 22.

Typically, two individual holding shelves 20 are utilized to hold a PPE dispenser. For example, and as illustrated in FIG. 2, a first holding shelf 32 is mounted on mounting frame 22 to engage a bottom of a PPE dispenser and a second holding shelf 34 is mounted to engage a top of the PPE dispenser. As illustrated in FIG. 2 mounting frame 22 further includes frame mounting holes 38 which are utilized to attach mounting frame 22 to a door or wall or the like.

Figure 3:
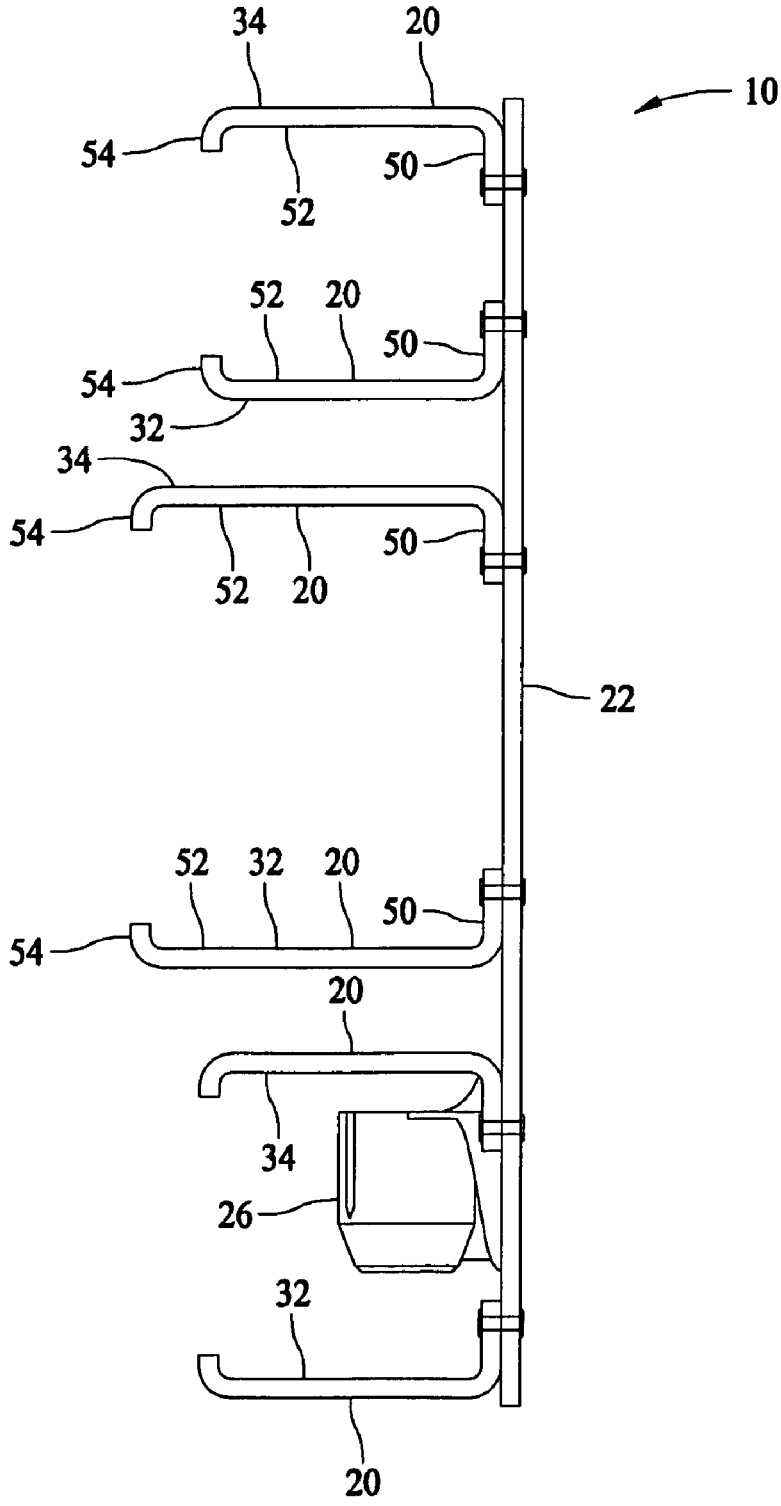
FIG. 3 is a right side plan view of the expandable shelving apparatus of FIG. 2.

FIG. 3 is a side plan view of expandable shelving apparatus 10 which illustrates the substantial "U" shape of individual holding shelves 20. More specifically, holding shelves 20 each include a first portion 50 oriented substantially adjacent mounting frame 22, a horizontal portion 52 extending substantially perpendicularly from first portion 50 and a second portion 54 extending substantially perpendicularly from horizontal portion 52. In one embodiment, second portion 54 is shorter than first portion 50. Together, and as illustrated, first portion 50, horizontal portion 52, and second portion 54 form the above described substantial "U" shape. Two holding shelves 20 mounted to mounting frame 22 in an orientation opposite one another, as illustrated, is configured to substantially surround the PPE dispenser while allowing access to any openings in the PPE dispenser whereby items within the PPE dispenser can be accessed and removed. The combination of two oppositely mounted holding shelves 20 further assures a secure holding of a PPE dispenser that has been inserted between a pair of oppositely mounted holding shelves 20.

Figure 4:
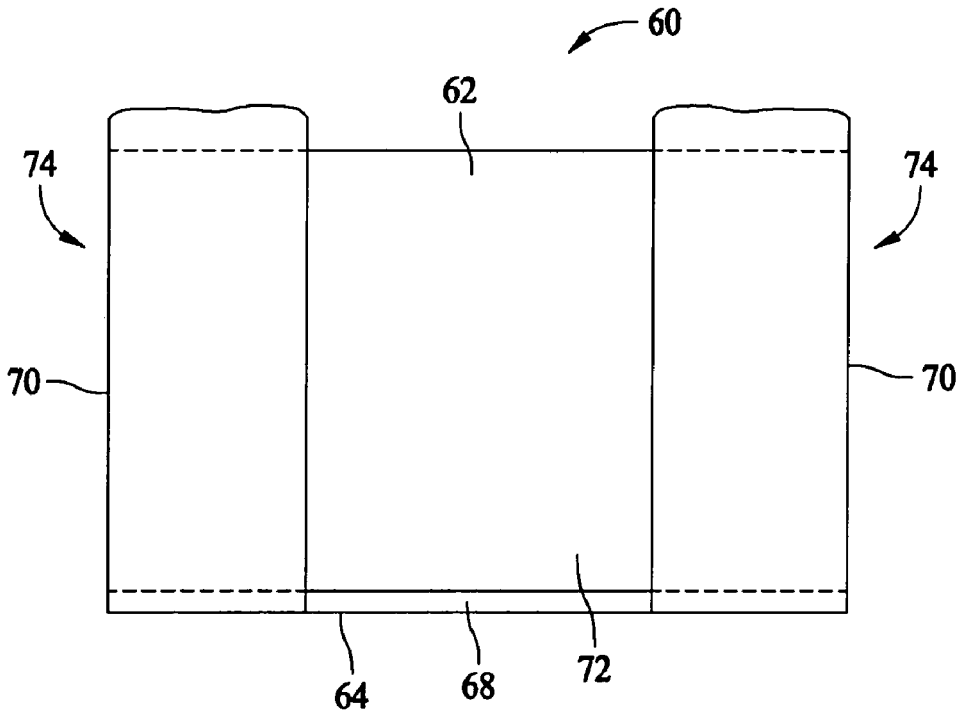
FIG. 4 is a front view of one embodiment of a shelf that can be utilized with the expandable shelving apparatus of FIG. 1
Figure 5:
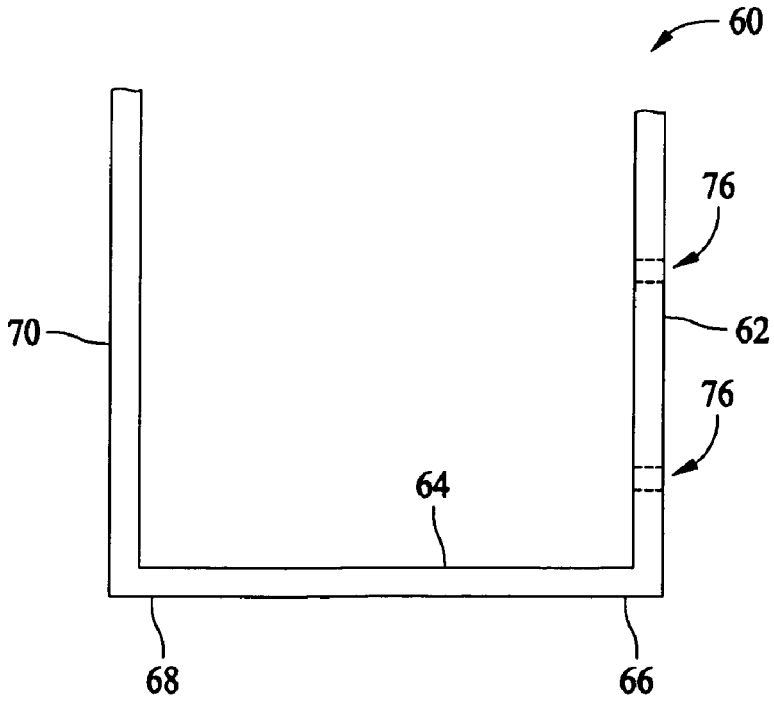
FIG. 5 is a cross-sectional view of the shelf of FIG. 4.

FIGS. 4 and 5 are respectively front and cross-sectional views of an open top container 60 which provides access to items stored within via an opening within a front of container 60. More specifically, container 60 includes a back wall 62 configured to attach to mounting frame 22 (shown in FIG. 1) and a bottom portion 64 extending from a first end 66 substantially horizontally from a bottom of back wall 62 to a second end 68. Two upward extending members 70 extend substantially vertically from second end 68 of bottom portion 64 and are separated by an open area 72 therebetween which provides access for a user to grasp one of a number of items, for example, folded medical examination gowns, that have been stacked within container 60. In one embodiment, side walls 74 extend between upward extending members 70 and back wall 62. Holes 76 for mounting container 60 extend through back wall 62 as shown in FIG. 5. Holes 76 are spaced to enable mounting of container 60 to mounting frame 22 utilizing mounting holes 24 (both shown in FIG. 1). Container 60 is utilized to store items which do not easily fit within the previously described holding shelves 20.

Figure 6:
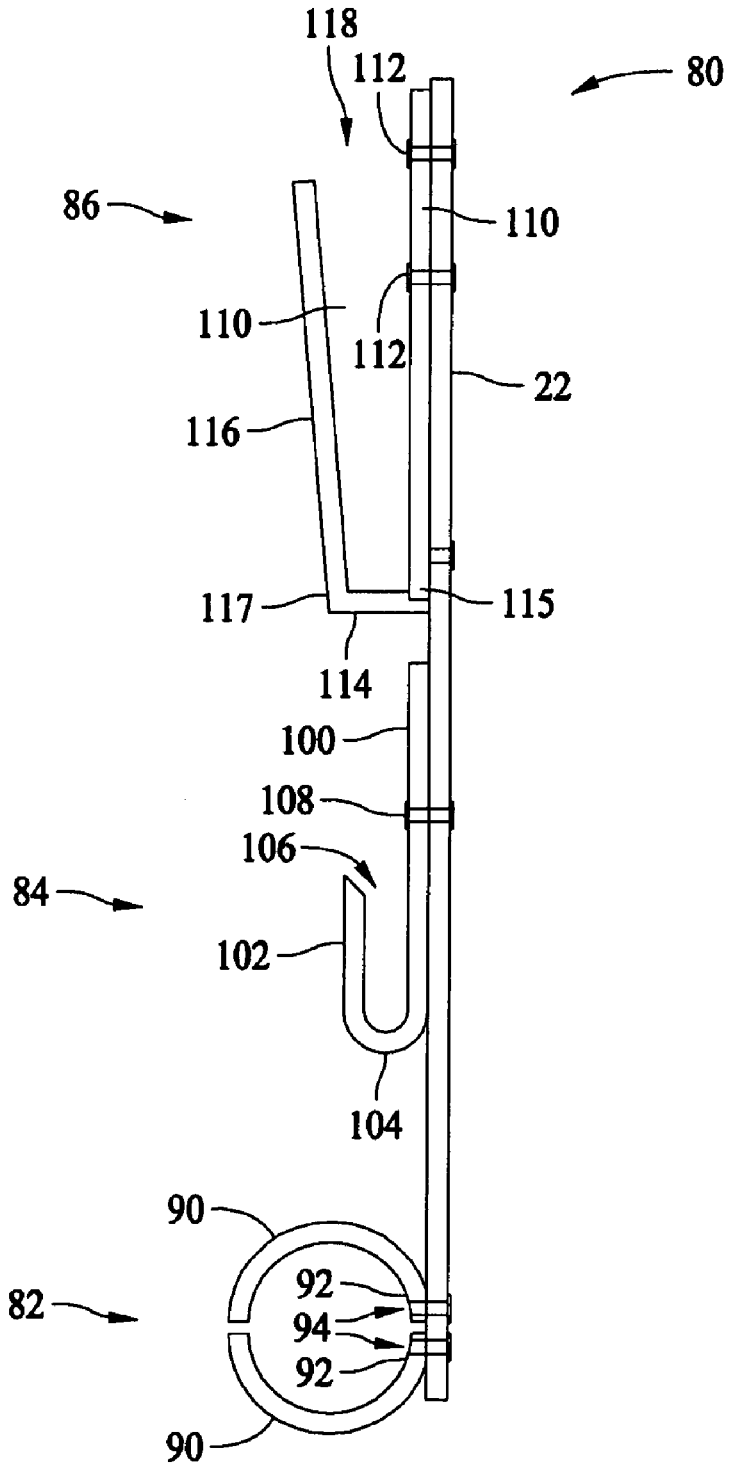
FIG. 6 is a side view of a shelving apparatus illustrating additional devices for holding items.

FIG. 6 is a cross sectional view of a shelving apparatus 80 which incorporates mounting frame 22 (also shown in FIG. 1) and a circular shelf 82, a hanger 84, and a file holder 86 all installed onto mounting frame 22. Shelving apparatus 80 is shown and described herein to further illustrate different components that can be utilized with mounting frame 22. More specifically, each circular shelf 80 is formed from two shelf portions 90 that have substantially semi-circular cross section. Each semi-circular shelf portion 90 is formed with a back section 92 configured to be mounted adjacent mounting frame 22. Back section 92 includes shelf holes 94 formed therethrough which are spaced to match the spacing of mounting holes 24 of mounting frame 22. A pair of oppositely oriented semi-circular shelf portions 90 are utilized for storing objects which are tubular in form, such as sterilization fluids or other materials packaged in a tubular can form. Semi-circular shelf portions 90 are utilized, for example, as a substitute for canister insertion shelf 26 (shown in FIG. 1), although for a number of tubular cans, both canister insertion shelf 26 and circular shelf 80 my be utilized.

Hanger 84 has a substantial hook shape and includes a back 100 configured to be attached to mounting frame 22 and an outward extending portion 102 extending from a bottom 104 of back 100 thereby forming an opening 106 for insertion of coat hangars, lab coats, loops sewn in garments and the like. Hanger 84 may also be utilized for the hanging and storage of stethoscopes and other medical equipment. Hanger 84 further includes shelf holes 108 formed through back 100 which are spaced to match the spacing of mounting holes 24 of mounting frame 22.

FIG. 6 also includes a cross-sectional view of a file holder 86 that may be attached to mounting frame 22. File holder 86 includes a back portion 110 configured to be attached to mounting frame 22. Back portion 110 includes shelf holes 112 formed therethrough which are spaced to match the spacing of mounting holes 24 of mounting frame 22. File holder 86 further include a bottom portion 114 extending substantially perpendicularly from a bottom 115 of back portion 110 and a front portion 116 which extends at a substantial angle from a front 117 of bottom portion 114. The combination of back portion 110, bottom portion 114, and front portion 116 form a slot 118 for insertion of files, papers, brochures and the like. In one embodiment, file holder 86 includes side portions (not shown) extending across back portion 110, bottom portion 114, and front portion 116 which prevent the inserted items from falling out of file holder 86.

Figure 7:
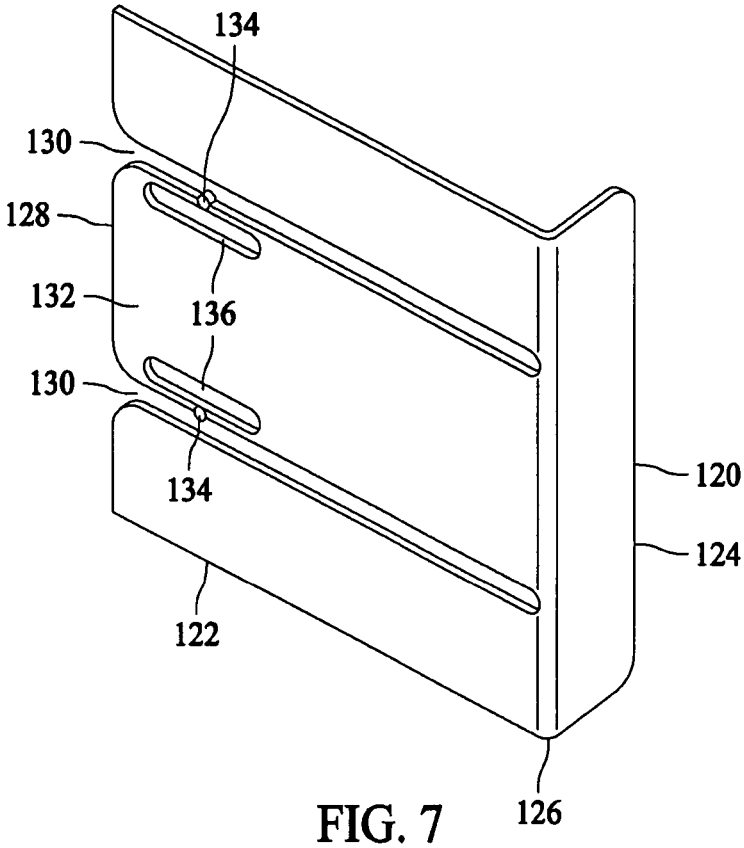
FIG. 7 is a perspective view of a first portion of an expandable shelf for the expandable shelving apparatus of FIG. 1.
Figure 8:
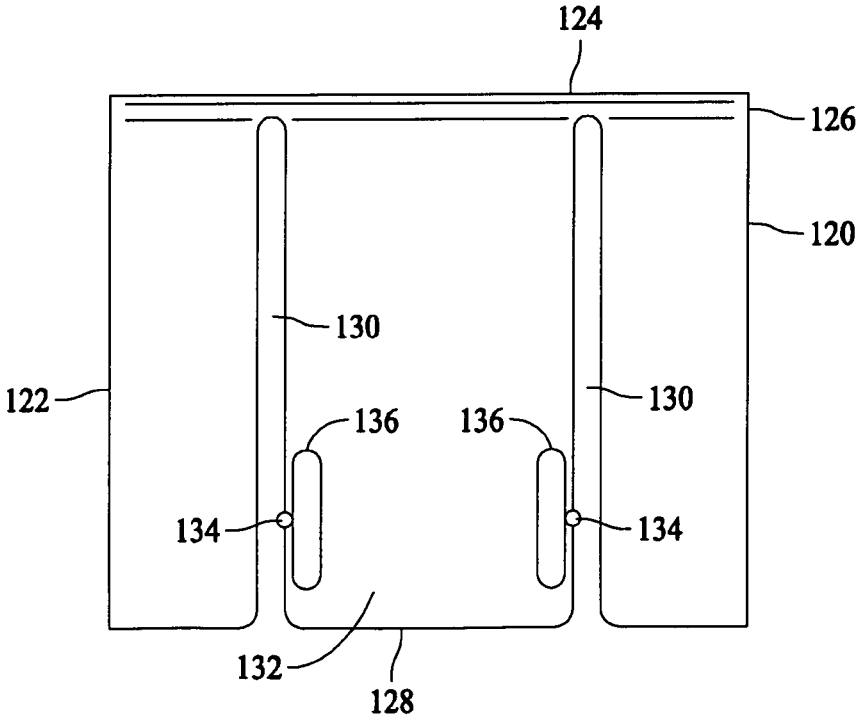
FIG. 8 is a bottom view of the first portion of the expandable shelf of FIG. 7.

FIG. 7 is a perspective view of an inner tray portion 120 of an expandable shelf system which may be utilized with mounting frame 22. As further described below (with respect to FIGS. 9 and 10), the expandable shelf system also includes an outer tray portion. Inner tray portion 120 includes a body portion 122 and an end portion 124 which extends substantially perpendicularly from a first end 126 of body portion 122. Extending along a length of body portion 122 from second end 128 are two slots 130 spaced a distance apart thereby forming an inner tray tongue 132 between slots 130. Inner tray tongue 132 includes one or more protrusions 134 extending therefrom and into slots 130 which help to secure inner tray portion 120 to the outer tray portion below described. In the embodiment, inner tray tongue 132 is further configured with one or more openings 136 formed substantially adjacent protrusions 134. Based on a flexibility of the material from which inner tray portion 120 is formed, openings 136 in inner tray tongue 132 allow protrusions 134 to retract somewhat when engaging an outer tray portion. Protrusions 134 provide at least a portion of a retaining device when inner tray portion 120 engages the outer tray portion. FIG. 8 is a bottom view of inner tray portion 120 further illustrating slots 130, inner tray tongue 132, protrusions 134, and openings 136.

Figure 9:
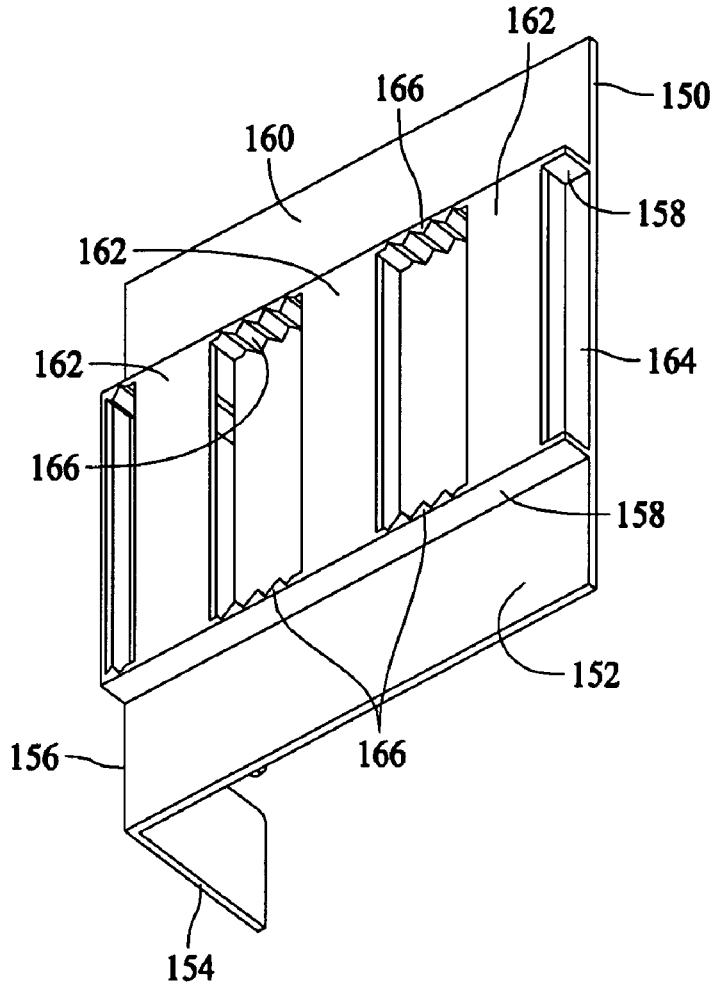
FIG. 9 is a perspective view of a second portion of an expandable shelf utilized with the first portion of FIG. 1.

FIG. 9 is a perspective view of an outer tray portion 150 of an expandable shelf system which may be utilized with mounting frame 22. As described above, outer tray portion 150 is configured to engage inner tray portion 120 (shown in FIGS. 7 and 8) to form the expandable shelf system. Outer tray portion 150 is a substantially "L" shaped member including a body portion 152 and an end portion 154 extending in the "L" shape from a first end 156 of body portion 152. Outer tray portion 150 includes rails 158 extending from an underside 160 of body portion 152. A plurality of perpendicular members 162 extend between rails 158 forming a channel 164 bordered by a portion of body portion 152, rails 158 and perpendicular members 164. Channel 164 is thus configured for insertion of inner tray tongue 132 of inner tray portion 120 (shown in FIGS. 7 and 8). An area of rails 158 between respective perpendicular members 162 is configured as a series of triangular (or another shape) notches 166 configured to engage protrusions 134 of inner tray portion 120 providing detent positions as inner tray portion 120 and outer tray portion 150 engage one another as above described allowing a user to create desired length for shelf system.

Figure 10:
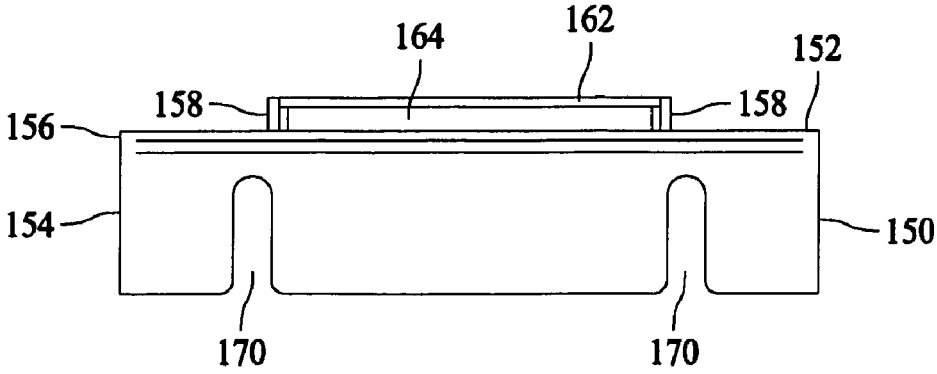
FIG. 10 is an end view of the second portion of the expandable shelf of FIG. 9.

FIG. 10 is an end view of outer tray portion 150 illustrating that end portion 154, in one embodiment, is configured with one or more shelf holes or shelf slots 170 formed therein which allow the combination of inner tray portion 120 and outer tray portion 150 to be placed and mounted on mounting plate 22 (shown in FIG. 1). When assembled, the expandable shelf is utilized as a holding shelf with the advantage of expandability for various box or dispenser sizes. Alternative embodiments of the expandable shelf may utilize a plurality of tray sliding, mating, and engaging techniques other than those described herein, including, but not limited to grooves and slots, various forms of channels, dovetail mates, clips, hook and loop fasteners, or adhesives.

Figure 11:
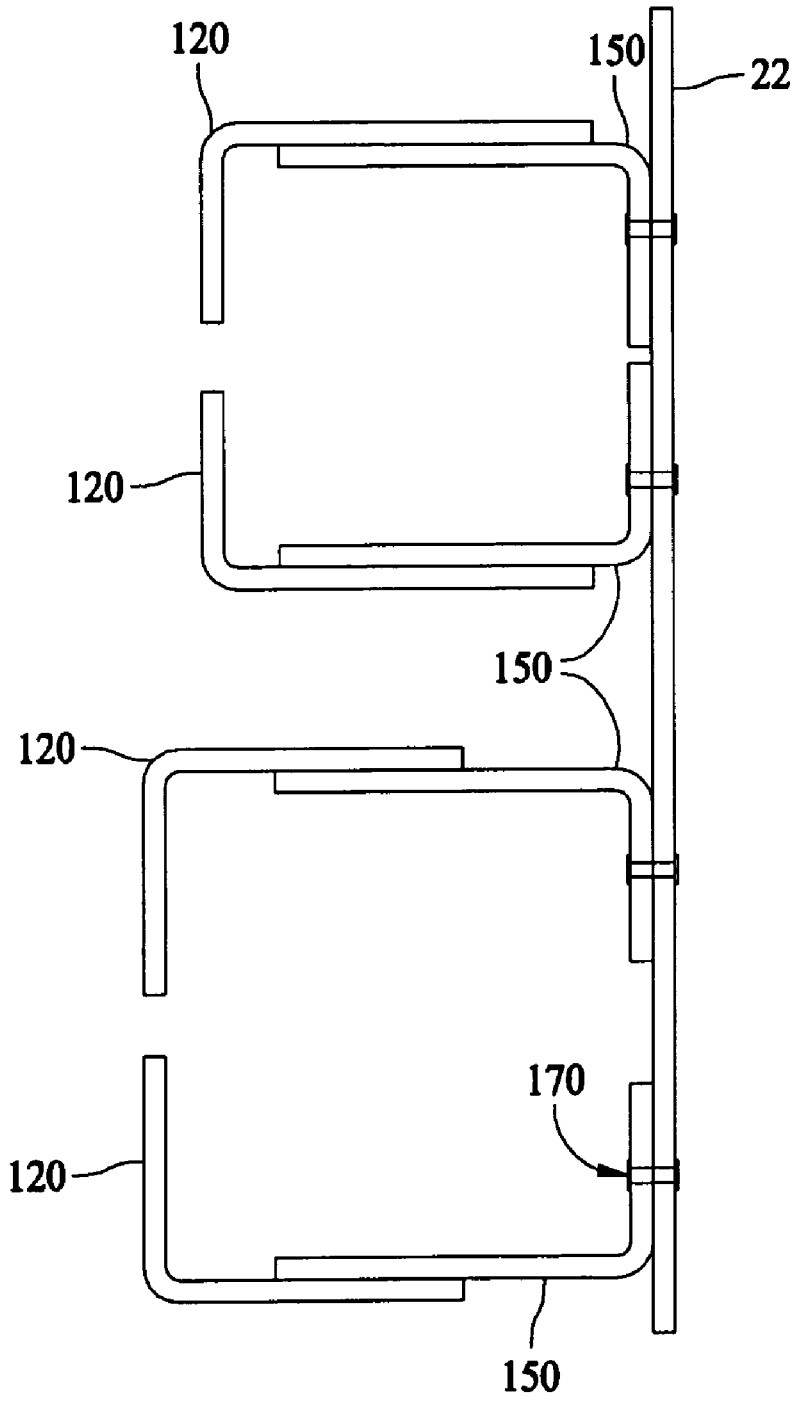
FIG. 11 is a side plan view of an expandable shelving apparatus incorporating a plurality of the expandable shelves of FIGS. 7-10.

FIG. 11 is a side plan view of an expandable shelving apparatus incorporating a plurality of the expandable shelves, each including an inner tray portion 120 engaging an outer tray portion 150 that is attached adjacent mounting frame 22. As illustrated, the expandable shelf system provides the same substantial "U" shape of individual holding shelves 20 (shown in FIG. 3). Similarly to individual holding shelves 20, components of the expandable shelving system may be attached to mounting frame 22 at various positions, in an orientation opposite one another, as illustrated, thereby affording accommodation of PPE dispensers of varying heights. In addition, the capability to adjust a position of inner tray portion 120 with respect to outer tray portion 150 allows a user to insert PPE dispensers of varying depth between a pair of the expandable shelves. This capability allows a user to further customize the herein described shelving apparatus for their particular needs or their changing needs. Further, the capability of the expandable shelving apparatus provides a capability that allows a user to adapt to changes made to the dimensions of PPE dispensers made by the suppliers of such PPE dispensers without forcing a user to reconfigure shelving apparatus 10.

Figure 12:
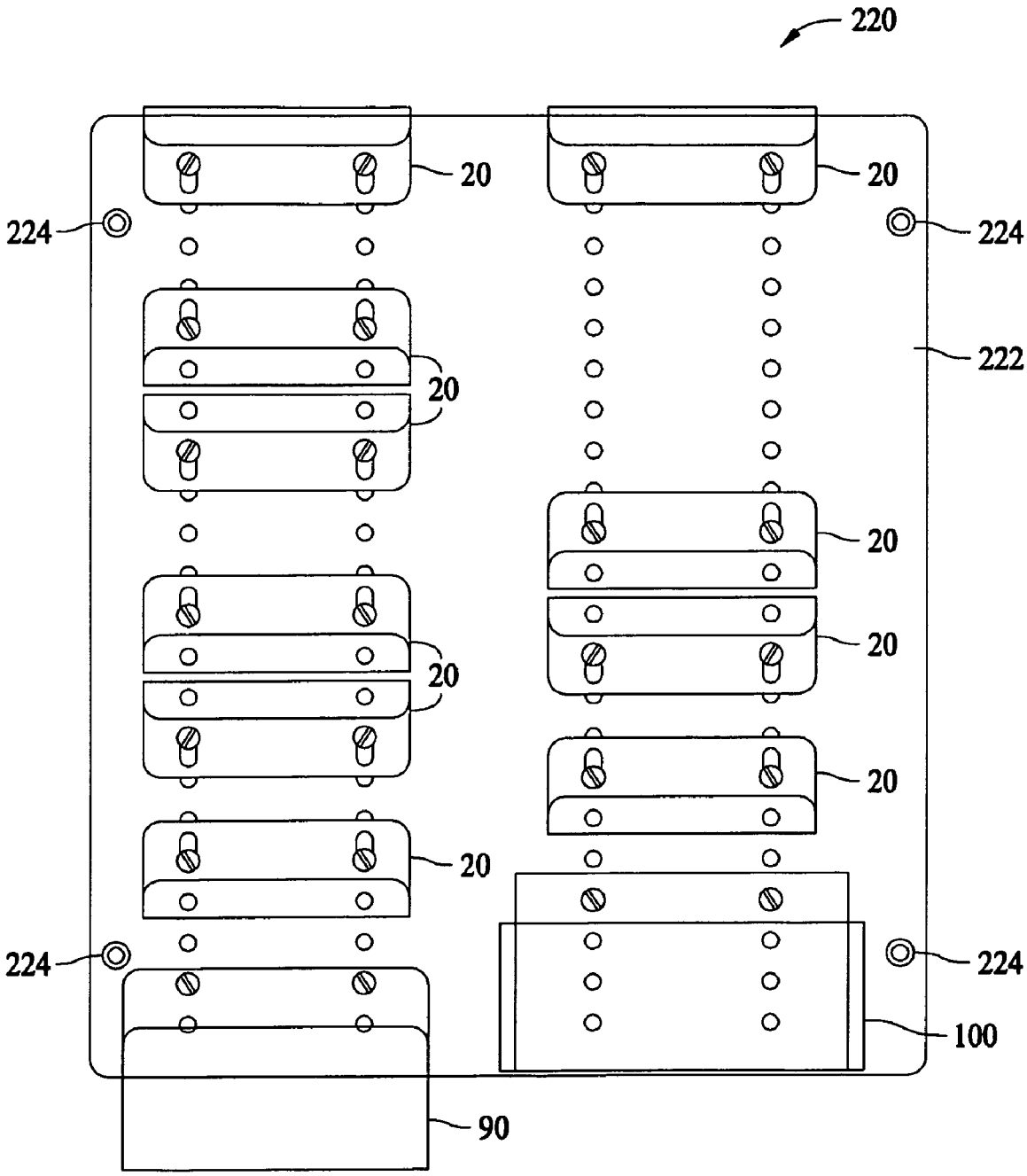
FIG. 12 is a front view of another mounting plate for providing an expandable shelving apparatus including a plurality of holding shelves and file folders attached thereto.

FIG. 12 is a front view of an alternative embodiment of a shelving apparatus 220 which includes a dual width mounting frame 222. Mounting frame 222 is shown having a plurality of holding shelves 20, a file folder 100 and a hangar 90 mounted thereon. Dual width mounting frame 222 helps to illustrate that multiple embodiments of mounting frames exist for utilization in a shelving apparatus. In addition to the wall mounted versions illustrated herein (i.e., mounting frame 22 and mounting frame 222), other embodiments include a glass mounted mounting frame and a door mounted mounting frame which incorporates one or more units which attach to the mounting frame and extend over the door.

As is the case with mounting frame 22 described above, mounting frame 222 includes mounting holes 224 formed therethrough. Mounting holes 224 (and mounting holes 24 shown in FIG. 1) allow for wall or door mounting of the plate with bolts, screws, or other fasteners. In an alternative embodiment, at least one suction cup is mounted within mounting holes (24 and 224) such that the suction cups adhere to a wall or mounting surface.

Figure 13:
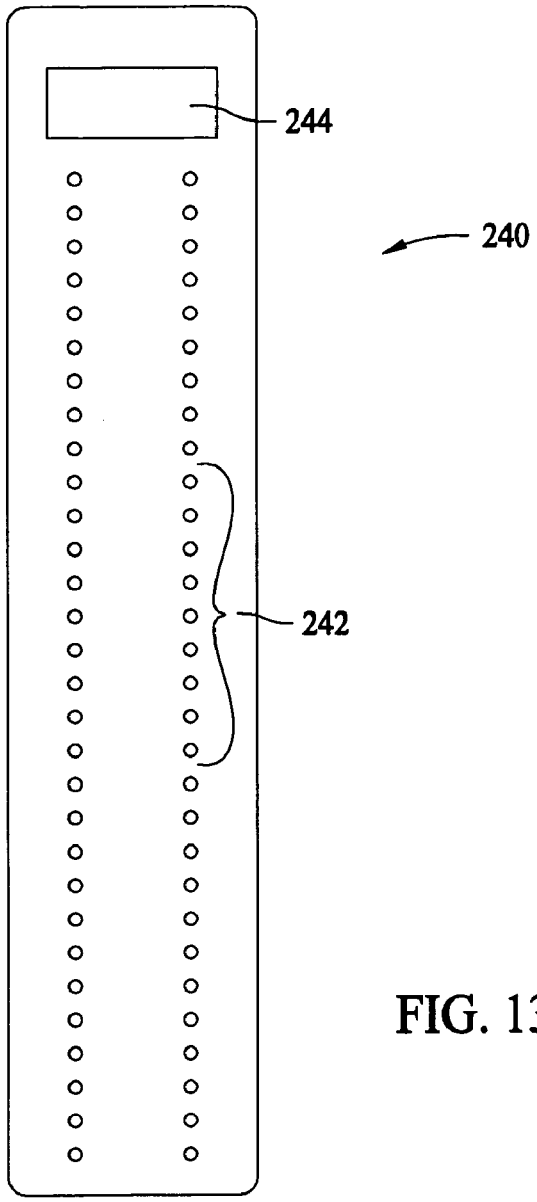
FIG. 13 is a front view of another mounting plate for providing an expandable shelving apparatus.

FIG. 13 is an illustration of another embodiment of a mounting frame 240 which can be utilized as a part of a shelving apparatus. Mounting frame 240 is configured with mounting holes 242 in the same pattern as, for example, mounting frame 22 and can accommodate all of the mounting shelves, circular shelves, canister holding shelves, file folders, and hangars described herein. In addition, mounting frame 240 is not configured with plate mounting holes as are mounting frames (22 and 222). Rather, mounting frame 240 is configured with a hangar engaging opening 244, which is utilized to engage a hanging hook (described below) in order to hang mounting frame 240.

Figure 14:
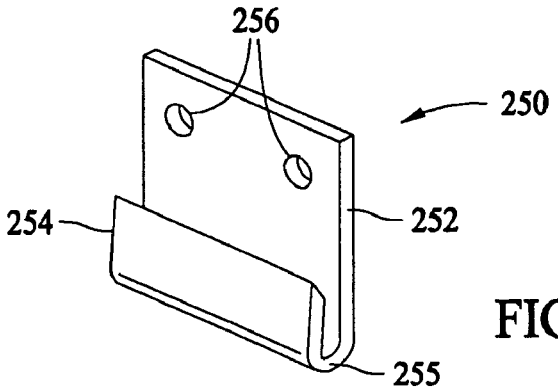
FIG. 14 is a front perspective view of a hanging hook utilizing in mounting the mounting plate of FIG. 13.
Figure 15:
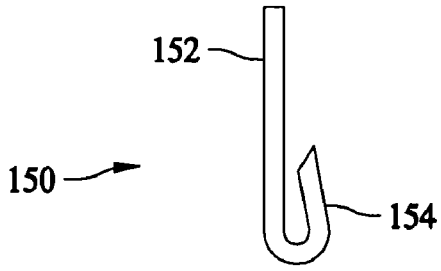
FIG. 15 is a side view of the hanging hook of FIG. 14.
Figure 16:
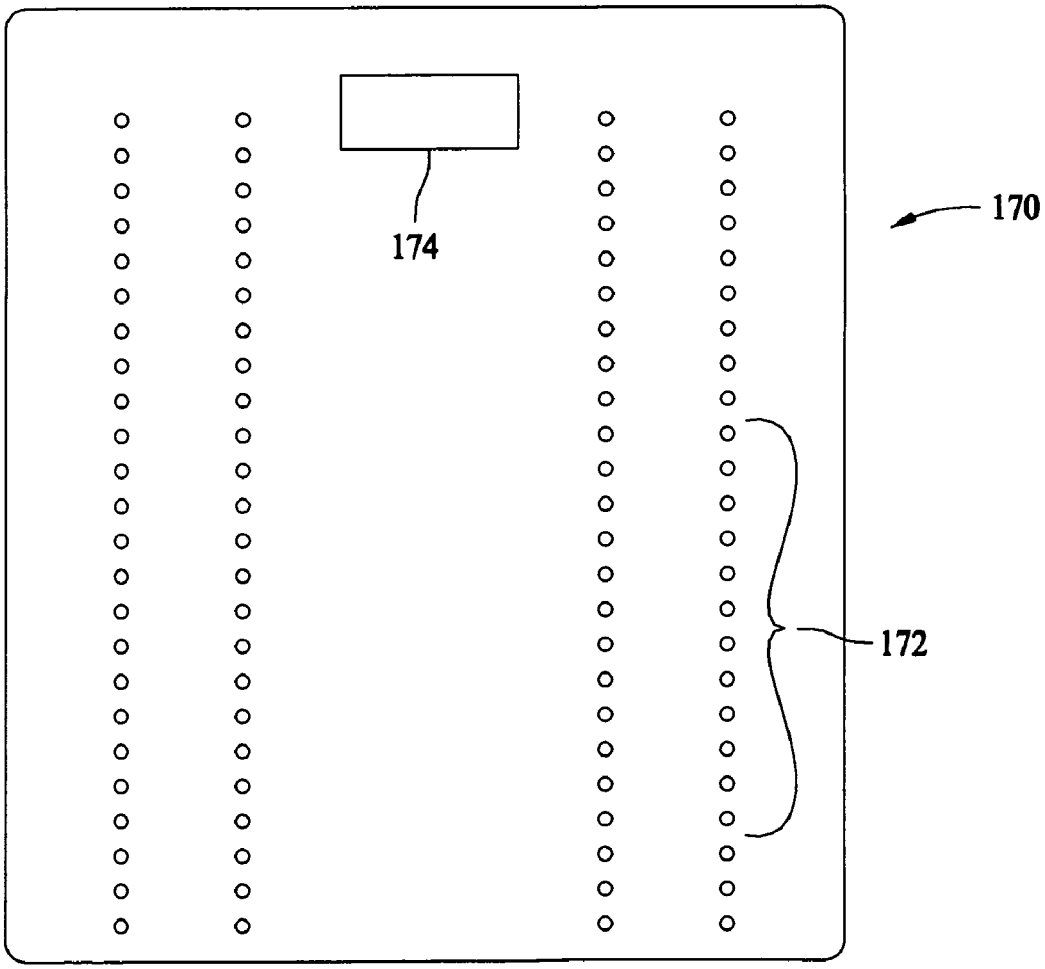
FIG. 16 is a front view of a dual width mounting plate configured to be hung utilizing the hanging hook of FIGS. 14 and 15.

FIG. 14 is an illustration of a hanging hook 250, sometimes referred to as a wall mount plate. Hanging hook 250 is especially useful for mounting mounting frame 240. Hanging hook 250 includes a back member 252 that is typically longer than a front member 254 which extends arcuately from a bottom 255 of back member 252. Hanging hook 250 includes one or more mounting holes 256 formed through back member 252 which are utilized for screw or other fastener attachment to walls or doors. When hanging hook 250 hook is attached to a wall, door, or surface, a user may engage hanging hook 250 with a hangar engaging opening 244 of mounting frame 240. Once the engagement is completed, mounting frame 240 is held within the substantial "U" shape formed by back member 252 and front member 254 via hangar engaging opening 244. Mounting holes 256 may also be utilized for the mounting of suction cups, which allows hanging hook 250, and then mounting frame 240, to be hung from surface unsuitable for screws, bolts and the like, for example, windows and other glass and ceramic surfaces. FIG. 15 is a side view of hanging hook 250 which better illustrates the substantial "U" shape above described. FIG. 16 is an illustration of one embodiment of a dual width mounting frame 270 which incorporates mounting holes 272 and a hangar engaging opening 274 that is configured for operation similarly to hangar engaging opening 244 (shown in FIG. 13). In addition to providing an opening for mounting, hangar engaging openings (244 and 274) allow a user to carry the respective mounting frame with shelves, brackets, and accessories attached. For example, the user can insert a hand through the hangar engaging opening and carry an assembled and stocked shelving apparatus.

In operation, the above described shelves, hangars, file folders and trays are attached to the respective mounting frame in a configuration which is desired. If utilizing the above described expandable shelves, the shelves can be adjusted as desired either before or after attachment to the respective mounting frame. The mounting frame is then mounted onto a wall, window, door, or other surface, whether with fasteners or suction cups. The user then installs the packaged items on or between the respective shelves, hangars, file folders and trays. Dispensing boxes installed into the shelves are typically slid between the oppositely oriented shelves for placement. Other PPE items, as desired, are also placed into the opened faced box. The user then utilizes the items within the boxes or brackets until depleted. Once depleted, the user simply removes the depleted box or dispenser and installs another box or dispenser with desired items, without removing the mounting plate. Typically, all of the aforesaid boxes are frictionally held within the shelves and any canisters are held gravitationally within the canister insertion shelves. Alternative embodiments may utilize other holding forms such as adhesives, fasteners, including hook and loop, and snap fittings.

In a preferred form, the respective mounting frame and associated shelves hangars, file folders and trays are manufactured from a polymer material, preferably transparent or clear, but alternative embodiments may be manufactured from any material having the strength to hold the aforesaid items. Said materials include but are not limited to woods, composites, metals, and alloys thereof.

The above described shelving apparatus provides a convenient method of storage and retrieval of common items utilized in the medical field or other fields. Such items include, but are not limited to, examination gloves, face masks, protection gowns, and hand wash, all of which are typically, but not exclusively, prepackaged in box or dispenser form.

While the invention has been described in terms of various specific embodiments, those skilled in the art will recognize that the invention can be practiced with modification within the spirit and scope of the claims.

What is claimed is:

1. A shelving apparatus comprising:

a mounting frame configured for attachment to a surface, said mounting frame further comprising a plurality of mounting holes formed therethrough; and a plurality of holding shelves each configured to be attached to said mounting frame utilizing said mounting holes, each pair of said holding shelves comprises an upper shelf and a lower shelf separately mountable to said mounting frame vertically opposed to one another, said upper and lower shelves engageable with an item inserted between said upper and lower shelves of said pair of holding shelves.

2. A shelving apparatus according to claim 1 further comprising one or more of, file holders, hangars, and canister insertion shelves each configured for attachment to said mounting holes of said mounting frame.

3. A shelving apparatus according to claim 1 wherein said two holding shelves each comprise a substantially "U" shaped cross-section.

4. A shelving apparatus according to claim 1 wherein said two holding shelves each comprise a substantially semicircular cross-section.

5. A shelving apparatus according to claim 1 wherein said mounting frame comprises frame mounting holes for mounting said mounting frame to a surface.

6. A shelving apparatus according to claim 1 further comprising a hanging hook, said mounting frame comprising a rectangular opening formed therein, said rectangular opening configured to engage said hanging hook.

7. A shelving apparatus according to claim 1 wherein said holding shelves comprise openings formed therethrough, said openings spaced to align with a portion of said mounting holes through said mounting frame.

8. A shelving apparatus according to claim 1 further comprising at least one fastener inserted through said opening and said mounting hole.

9. A shelving apparatus according to claim 1 wherein said plurality of holding shelves each comprise a first portion configured to be oriented substantially adjacent said mounting frame, a horizontal portion which extends substantially perpendicularly from said first portion, and a second portion which extends substantially perpendicularly from said horizontal portion.

10. A shelving apparatus according to claim 1 further comprising a container which comprises a back wall configured to be attached to said mounting frame, said back wall comprising a bottom, a bottom portion having a first end and a second end, said bottom portion configured to extend from said first end substantially horizontally from said bottom of said back wall to said second end, and two upward extending members configured to extend substantially vertically from said second end of said bottom portion, said upward extending members separated by an open area therebetween.

11. A shelving apparatus according to claim 10 wherein said container comprises two side portions, each said side portion extending between said back wall and one of said upward extending members.

12. A shelving apparatus according to claim 1 wherein each said holding shelf further comprises an expandable shelf system configured to be attached to said mounting frame.

13. A shelving apparatus according to claim 12 wherein said expandable shelf system comprises an inner tray portion comprising a body portion and an end portion extending substantially perpendicularly an end of said body portion; and an outer tray portion configured to engage said inner tray portion, said outer tray portion comprising a body portion having an underside and an end portion extending in an "L" shape from an end of said body portion.

14. A shelving apparatus according to claim 13 wherein:

said body portion of said inner tray portion comprises an inner tray tongue formed by two slots extending along a length of said body portion separated by a distance; and said outer tray portion comprises a pair of rails extending from said body portion underside and a plurality of perpendicular members extending between said rails, said underside, said rails and said perpendicular members forming a channel for insertion of said inner tray tongue of said inner tray portion.

15. A shelving apparatus according to claim 14 wherein said inner tray tongue comprises at least one protrusions extending therefrom and into said slots, said rails comprising a series of notches formed thereon, said notches configured to engage said protrusions to provide detent positions as said inner tray portion and said outer tray portion engage one another.

16. A shelving apparatus according to claim 1 further comprising a hanging hook that comprises:

a back member comprising a bottom; and a front member extending arcuately from said bottom of said back member, said mounting frame comprising a rectangular opening formed therein, said rectangular opening configured to engage said hanging hook between said front member and said back member.

17. A shelving apparatus according to claim 16 wherein said hanging hook comprises at least one mounting hole formed through said back member.

18. An apparatus for retaining an item, said apparatus comprising a first holding shelf and a second holding shelf, said first and second holding shelves configured for attachment to a mounting frame, said first and second holding shelves separately attachable to the mounting frame in an orientation vertically opposed to one another, said first and second shelves engageable with an item inserted between said first and second holding shelves.

19. An apparatus according to claim 18 wherein said holding shelves each comprise a first portion, a horizontal portion which extends substantially perpendicularly from an end of said first portion, and a second portion which extends substantially perpendicularly from an end of said horizontal portion opposite said first portion.

20. An apparatus according to claim 18 wherein said first portion, said horizontal portion, and said second portion comprise a "U" shaped cross-section.

21. An apparatus according to claim 18 wherein said holding shelves each comprise a substantially semi-circular cross-section.

22. A shelving apparatus according to claim 18 wherein said holding shelves comprise openings formed therethrough, said openings spaced to align with mounting holes through the mounting frame.

23. An expandable shelf system configured to be attached to a mounting frame, the mounting frame configured to be attached to a substantially vertical surface, said expandable shelf system comprising:

an inner tray portion comprising a body portion and an end portion extending substantially perpendicularly from an end of said body portion; and an outer tray portion configured to engage said inner tray portion, said outer tray portion comprising a body portion having an underside and an end portion extending in an "U" shape from an end of said body portion.

24. An expandable shelf system according to claim 23 wherein:

said body portion of said inner tray portion comprises an inner tray tongue formed by two slots extending along a length of said body portion, the slots separated by a distance; and said outer tray portion comprises a pair of rails extending from said body portion underside and a plurality of perpendicular members extending between said rails, said underside, said rails, and said perpendicular members forming a channel for insertion of said inner tray tongue of said inner tray portion.

25. An expandable shelf system according to claim 24 wherein said inner tray tongue comprises at least one protrusion extending therefrom and into said slots, said rails comprising a series of notches formed thereon, said notches configured to engage said protrusions to provide detent positions as said inner tray portion and said outer tray portion engage one another.

* * * * *